United States Patent [19]

Bickford et al.

[11] 4,060,137

[45] Nov. 29, 1977

[54] TORQUE WRENCH

[75] Inventors: John H. Bickford, Middletown; Donald H. Ranheim, Jr., East Hartford; Willard A. Saxby, Newington, all of Conn.

[73] Assignee: Raymond Engineering Inc., Middletown, Conn.

[21] Appl. No.: 682,735

[22] Filed: May 3, 1976

[51] Int. Cl.[2] ..... B25B 23/145

[52] U.S. Cl. ..... 173/12; 73/136 R; 73/139

[58] Field of Search ..... 73/136 R, 139; 173/12

[56] References Cited

U.S. PATENT DOCUMENTS

| | | | |
|---|---|---|---|
| 2,724,266 | 11/1955 | Baker et al. | 73/136 R |
| 2,764,272 | 9/1956 | Reynolds | 173/12 X |
| 3,538,763 | 11/1970 | Amtsberg et al. | 73/139 X |
| 3,834,467 | 9/1974 | Fuchs | 73/136 X |
| 3,858,444 | 1/1975 | Wallace | 73/139 |
| 3,970,151 | 7/1976 | Workman, Jr. | 173/12 |

*Primary Examiner*—Charles A. Ruehl

[57] ABSTRACT

A torque wrench is presented having bidirectional operating capability, accurate readout, and preset or load selection capability. The input drives a pair of ring gears, one of which is connected to the output of the wrench and the other of which is part of a reaction arm system which interacts with the readout and preset features.

29 Claims, 5 Drawing Figures

TORQUE WRENCH

BACKGROUND OF THE INVENTION

This invention relates to the field of torque wrenches. More particularly, this invention relates to the field of pneumatically driven torque wrenches having continuous readout and preset capabilities, although features of the present invention may also be incorporated in a manually operated version of the wrench.

Known prior art torque wrenches, either of the general category of this invention or having specific features of interest, are found in the following U.S. Pat. Nos., which list is set forth in numerical order only and is intended to be illustrative and not all inclusive: Amtsberg et al. 3,538,763; Crooks et al. 3,525,256; Lehmann et al. 3,944,430; States 3,440,908; Loofbourrow 3,401,754; Reynolds 2,764,272; Zimmerman 2,183,633; and Zimmerman 2,144,731.

The wrench of the present invention is designed and is particularly suitable for low and moderate torque loads in the range of from about 50 to about 1000 foot-pounds, although wrenches in accordance with the present invention having greater capacity can, of course, be built. The wrench of the present invention is particularly suitable for use as a replacement for impact type wrenches.

As is well known, impact wrenches are noisy in operation and are inaccurate in regard to their output torques. The output inaccuracy poses a considerable safety hazard; parts can come apart in use if the torque imposed on fastening elements was too low, while bolts can be broken during assembly if applied torque is too high.

SUMMARY OF THE INVENTION

The torque wrench of the present invention is a pneumatically powered (in its preferred embodiment) torque wrench having continuous readout, load preset and automatic shutoff capabilities. The wrench is bidirectional in operation, and it is accurate and repeatable in the output imposed on times being torqued.

In the present invention an air motor drives a planetary gear system which has a pair of ring gears. One of the ring gears is connected to and forms part of the output of the wrench to apply torque to an item. The other ring gear forms part of a reaction arm and system which imposes a load on the housing of the wrench in proportion to the applied torque. The reaction arm also has a segment gear which is connected to both readout and preset systems. Movement of the reaction arm is proportional to the load being imposed by the wrench on an element being torqued, and movement of the reaction arm serves both to operate the readout system and to operate a shutoff valve when a preselected load level has been reached. A "no back" feature may also be employed to prevent drive back through the gear system to the input.

Accordingly, one object of the present invention is to provide a novel and improved torque wrench which is bidirectional in operation and which has a continuous readout.

Another object of the present invention is to provide a novel and improved torque wrench which is bidirectional in operation and has continuous readout and preset load selection capabilities.

Still another object of the present invention is to provide a novel and improved torque wrench in which operation of the wrench will be automatically discontinued upon reaching a predetermined torque level.

Still another object of the present invention is to provide a novel and improved readout system for a torque wrench.

Still another object of the present invention is to provide a novel and improved readout system for a torque wrench, the readout system having an integral ring gear and reaction arm connected to the input, the reaction arm loading a heavy spring in proportion to the output of the wrench, the movement of the reaction arm being used to provide a readout of the torque level.

Other objects and advantages of the present invention will be apparent to and understood by those skilled in the art from the following detailed drawings and description.

BRIEF DESCRIPTION OF THE DRAWINGS

Referring now to the drawings wherein like elements are numbered alike in the several figures.

DESCRIPTION OF THE PREFERRED EMBODIMENT

Figure 1:
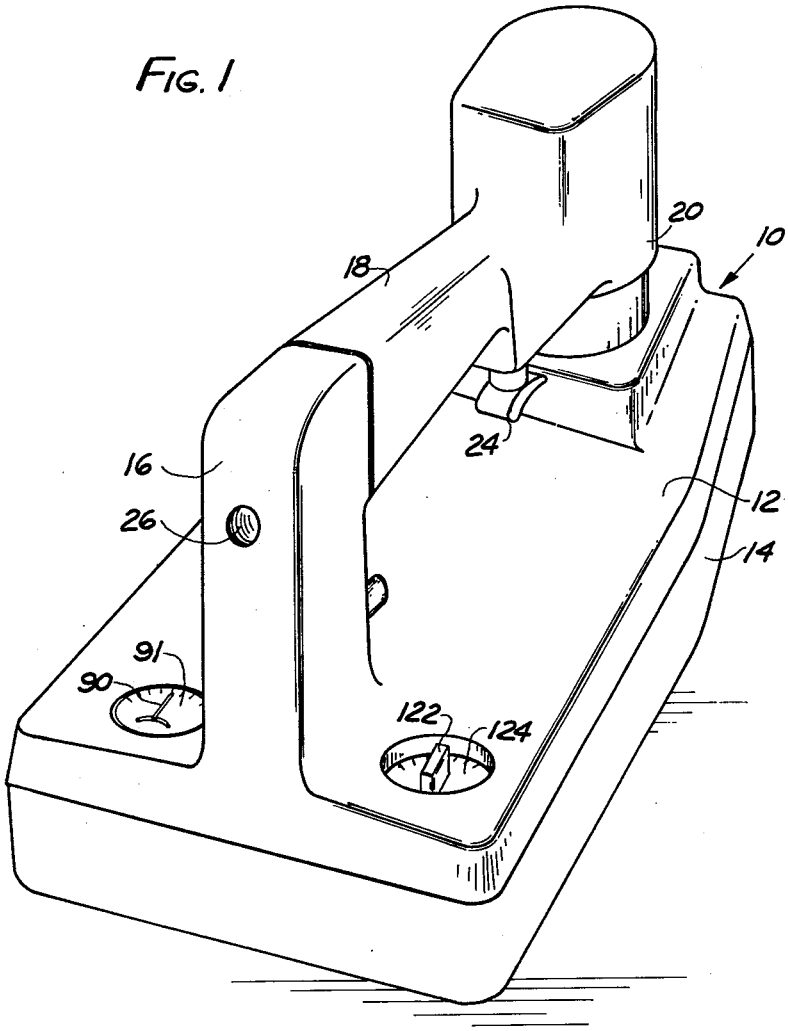
FIG. 1 is a perspective view of the pneumatically powered torque wrench version of the present invention.
Figure 2:
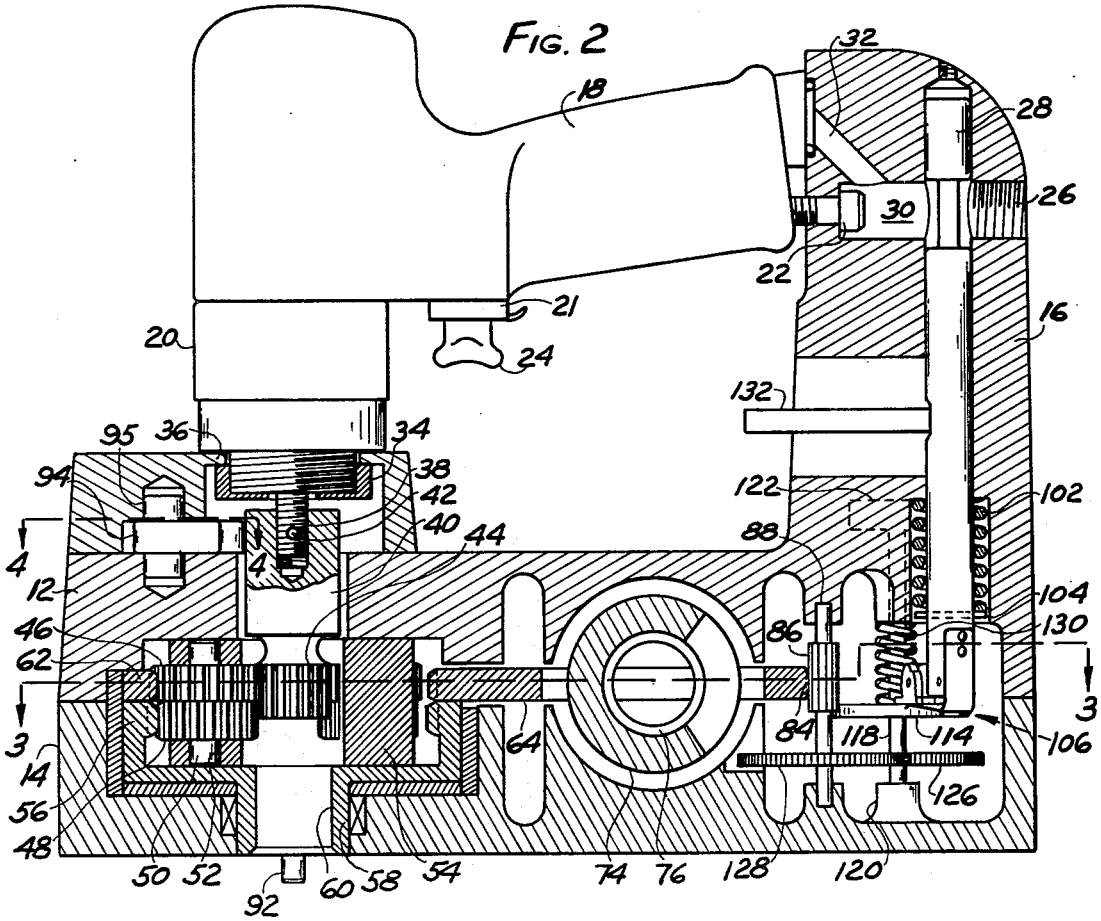
FIG. 2 is a sectional elevation view of the torque wrench of the present invention, taken centrally of the wrench.

Referring now to FIG. 1, the torque wrench, indicated generally at 10, has an upper casing segment 12 and a lower casing segment 14. A post 16 projects upwardly from upper case 12, and the pistol grip 18 of a hand operable air motor 20 is connected to post 16. Pistol grip 18 is secured to post 16 in any convenient fashion, such as, for example, by the threaded fastening element 22 shown in FIG. 2. Air motor 20 is operated by manually depressing trigger or plunger 24 to allow air to flow through pistol grip 18 to the operating elements of the air motor. Air motor 20 and pistol grip 18 may be any commercially available reversible hand held air motor, the direction of rotation being selectable by the positioning of a switch such as switch 21 which rotates to operate a valve in the air motor to change the direction of rotation. A supply orifice 26 in post 16 serves to receive an air hose to deliver operating air to air motor 20. As seen in FIG. 2, a spool valve 28 serves to selectively admit or terminate the flow of air to air motor 20. When spool valve 28 is in the position shown in FIG. 2 air can flow through orifice 26, past the reduced diameter section of spool valve 28 into chamber 30 and passageway 32 to pistol grip 18 and thence to air motor 20. When spool valve 28 is moved downwardly so that the full diameter end portion is aligned with orifice 26, air flow to motor 20 is terminated and operation of the wrench ceases. Thus, operation of the air motor can be controlled by plunger 24 and valve 28.

Figure 3:
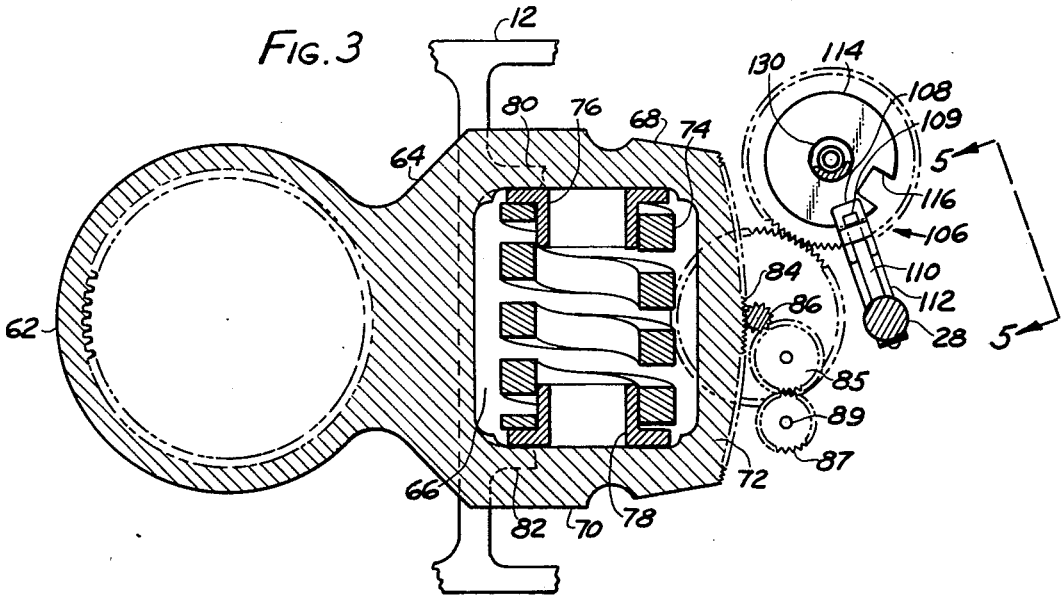
FIG. 3 is a partial plan view along line 3—3 of FIG. 2, with some gearing and case elements omitted for clarity.

Referring now to FIGS. 2 and 3, the output end of air motor 20 is threadably engaged with retainer 34 so that the air motor and retainer 34 butt against and firmly engage opposite sides of a circular flange 36 which defines a circular opening in upper housing 12. The output shaft 38 of air motor 20 extends into the interior of upper housing 12 and is threadably engaged with a cylindrical rod 40. A pin 42 passing through rod 40 and output shaft 38 prevents any relative movement between output shaft 38 and rod 40.

Rod 40 constitutes an input drive rod to a planetary gear train housed in the wrench. A gear 44 on rod 40 is the sun gear of the planetary gear train. Sun gear 44 engages two axially aligned planetary gears 46 and 48. The planetary gears 46 and 48 are affixed to a common shaft 50, shaft 50 being rotatably mounted in an opening 52 in an annular race or retainer 54. As will be apparent from the showing in FIG. 2, race 54 is a solid ring which has lateral and transverse slots to receive and mount gears 46 and 48 and pin 50. Race or retainer 54 is free to rotate about its own axis which is coaxial with the axis of sun gear 44. There are three sets of pairs of gears 46 and 48 located equidistantly about sun gear 44, the pairs of planetary gears 46 and 48 forming, in effect, two planetary systems driven by a single sun gear. The planetary gears 48 engage the teeth of a ring gear 56 which is an output gear directly connected to output coupling 58 which has a square shaped opening 60 to receive a square rod which will, in turn, carry an appropriately shaped driving head for the nut or bolt or other element to be torqued. Sun gear 44, planetary gear 48, ring gear 56 and coupling 58 constitute an output circuit in the torque wrench.

Planetary gears 46 engage a second ring gear which is part of a reaction arm 64. Reaction arm 64 has a central opening 66 bounded by side segments 68 and 70 and end segment 72 at the end of the reaction arm removed from ring gear 62. A very heavy spring, such as one having a spring rate of on the order of 4000 pounds per inch, is located in opening 66 between side elements 68 and 70. Centralizing bushings 76 and 78 project into each end of spring 74, and the bushings are located in chambers in the housing and bear against housing walls 80 and 82, respectively, as well as the side elements 68 and 70, when reaction arm 64 is in the null or unloaded position as depicted in FIG. 3.

A gear segment 84 on end element 72 of the reaction arm engages and drives a pinion 86 which is mounted on a rotatable shaft 88. Pinion 86 drives gears 85 and 87 to rotate a shaft 89 to which gear 87 is fixed. Shaft 89 is directly connected to a readout pointer 90 (see FIG. 1) so that movement of reaction arm 64 about the axis of ring gear 62 results in rotation of pinion 86 and shaft 89 whereby pointer 90 is moved to indicate the output torque load of the wrench. Thus, planetary gears 46, ring gear 62, reaction arm 64, spring 74, centralizing bushings 76 and 78, segment gear 84, pinion 86, shaft 88, gears 85 and 87, shaft 89 and pointer 90 constitute a readout circuit of the wrench.

In order for the wrench of the present invention to operate properly, a tooth difference must be established in the gears of the planetary system. This difference can be obtained either by establishing a different number of teeth on planetary gears 46 and 48 with the number of teeth of each of the ring gears being made equal; or difference can be obtained by an equal number of teeth on the planetary gears 46 and 48 and a different number of teeth on the ring gears 56 and 62. The particular manner in which this difference is established is a matter of engineering design or choice depending on several considerations, including, for example, the shape of the gear teeth. In the presently preferred embodiment of the invention, the number of teeth on the ring gears 56 and 62 are equal while the number of teeth on planetary gear 46 is one greater than the number of teeth on planetary gear 48. Also, the outside diameter of planetary gears 46, is slightly larger than the outside diameter of planetary gears 48, and the inside diameter of ring gear 62 is slightly larger than the inside diameter of ring gear 56. These differences in the gears will result in transmission of a rotary motion from input rod 40 to output coupling 58 when a load is imposed on the wrench.

If there is no load imposed on output coupling 58, the delivery of air to air motor 20 to rotate input rod 40 and sun gear 44 will result in rotation of planetary gears 46 and 48 about their own axis and precession of gears 46 and 48 and their cage 54 about the axis of the cage (which coincides with the axis of sun gear 44). This rotation and precession of gears 46 and 48 occurs because of the fact that spring 74 holds ring gear 62 stationary when there is no load on the wrench, thus resulting in the planetary gears 46 and 48 rotating about their own centers and traveling around their ring gears. Since there is a difference in the number of teeth between each planetary gear and its associated ring gear, ring gear 56 will move with respect to ring gear 62 and hence output coupling 58 will rotate. Thus, if desired, the torque wrench can be used to run down a nut or bolt which is under essentially no or low torque load.

When the item to be torqued is under a torque load, output coupling 58 encounters resistance, and this resistance or load encountered by output coupling 58 results in a somewhat different mode of operation of the gear train. To accomplish torquing of an element, the wrench, with the appropriately shaped driving head mounted in outlet coupling 58, is placed over the element to be torqued. A pair of reaction pins, only one of which can be seen in FIG. 2, extend from lower housing section 14 to engage a grounded reaction adapter in the conventional manner known for the use of torque wrenches. Air motor 20 is then activated to drive sun gear 44 in the desired direction. Assuming that it is desired to move output coupling 58 clockwise, sun gear 44 will be rotated counterclockwise to drive planetary gears 46 and 48 and ring geaar 56 clockwise, with resultant precession of gears 46 and 48 and their cage 54. As the load being experienced by output coupling 58 increases, i.e., as the item to be torqued is brought up increasingly tighter, the load resisting rotation of ring gear 56 becomes equal to or slightly exceeds the load resisting rotation of ring gear 62 as determined by the load of spring 76 on reaction arm 64. Ring gear 62 will then be incrementally rotated in a clockwise direction to load or compress spring 74 against housing wall 82. The incremental movement of ring gear 62 and reaction arm 64, and hence the load imposed on spring 74, is directly proportional to the torque being imposed on the element being torqued. The maximum permissible movement of reaction arm 64 is $\pm$ 10° about the axis of ring gear 62, that maximum movement and resultant compression of spring 74 being equivalent to the maximum output of the torque wrench. Similarly, if the element to be torqued is to be driven in a counterclockwise direction, the direction of rotation of air motor 20 and sun gear 44 are reversed, whereby the movement of ring gear 62 and reaction arm 64 will be in a counterclockwise direction to load spring 74 against housing wall 80.

As reaction arm 64 moves either clockwise or counterclockwise, segment gear 84 drives pinion 86 and gears 85 and 87 to rotate shaft 89 in an amount directly proportional to the torque output of the wrench. Thus, readout pointer 90, which is directly fixed to shaft 89, moves either clockwise or counterclockwise in an amount directly proportional to the torque load which can be read on indicating dial 91.

Figure 4:
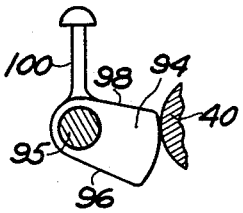
FIG. 4 is a detail of "no back" apparatus, taken on line 4—4 of FIG. 2.

The wrench incorporates a "no back" provision to prevent a drive in the reverse direction through the gear system in the event of a sudden relaxation in the input torque applied by the air motor. Referring to FIGS. 2 and 4, this "no back" provision takes the form of a sprag type element 94 which is pivotally mounting on pin 95 and is in sliding contact with drive rod 40. Sprag element 94 is sized so that side 96 is longer than side 98. Thus, when drive rod 40 is rotating counterclockwise the drive rod slides by sprag element 94 without interference. However, any undesired drive back through the system in the reverse direction will be prevented because any clockwise rotation of drive rod 40 will result in an interferring engagement between drive rod 40 and the longer side of sprag element 94, thus locking the drive rod against reverse rotation. A handle 100 extends from sprag element 94 and projects out of upper housing element 12 so that the sprag element can be disengaged by clockwise movement of handle 100 and sprag element 94 to permit operation of the torque wrench in the reverse direction if desired, i.e., to permit reversal of the direction of the operation of the air motor to ultimately drive output coupling 58 counterclockwise.

Figure 5:
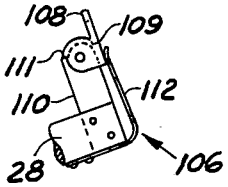
FIG. 5 is a detail of the load selection and reset system, taken on line 5—5 of FIG. 2.

As mentioned previously, the torque wrench incorporates a feature whereby the desired amount of output torque can be selectively preset and the wrench automatically deactivated when that torque level has been achieved. Spool valve 28 forms part of this preset and shutoff feature. A spring 102 in post 16 bears against a pin 104 in spool valve element 28 to load the spool valve element toward lower case section 14. A cam follower type element 106 is attached to the lower end of spool valve 28. As seen in FIG. 5, one way element 106 has a movable end plate 108 pivotally connected to an arm 110 pinned in a slot in the elongated end of spool valve element 28. A spring 112 pinned to valve element 28 loads end plate 108 counterclockwise against a stop 111 so that end plate 108 is normally in a perpendicular relationship to spool valve element 28 as shown in FIG. 5. A notch 109 in end plate 108 permits end plate 108 to move clockwise if loaded against spring 112. Element 106 bears against a cam plate 114 which has a notched segment 116. Cam plate 114 is mounted on a shaft 118 which is in turn rotatably mounted in a bushing 120, shaft 118 being both rotatable and translatable in bushing 120. The upper end of shaft 118 terminates in handle 122 (see also FIG. 1) which is on the exterior of upper case 12 and is accessible to the user of the wrench. Handle 112 is positioned opposite a stationary dial 124 which has markings thereon commensurate with desired levels of output torque for the wrench. The user of the wrench can grasp handle 122 and pull it upward and rotate it to vary the desired torque setting of the wrench. A gear 126 is also mounted on shaft 118, and gear 126 mates with and is driven by a gear 128 mounted on shaft 88. A spring 130 extends between upper case 12 and cam plate 114 to normally urge cam plate 114, shaft 118 and gear 126 to the position shown in FIG. 2 wherein gears 126 and 128 are in meshed engagement.

To select a desired torque setting for the wrench, the user lifts spool valve 28 upward, i.e., to its open position as shown in FIG. 2 by pulling upwardly on rod 132. The upward movement of spool valve 28 removes from the upper surface of cam plate 114 the load which might otherwise be imposed by spring 102 urging the spool valve down to load element 106 against the cam plate. Simultaneously with the lifting of spool valve 28, the user of the wrench also grasps handle 122 and pulls it upward to disengage gear 126 from gear 128 and rotates shaft 118 until handle 122 points to the desired load setting on dial 124. The user then releases handle 122 and rod 132 whereby spring 130 drives the cam plate 114 and gear 126 downward to reestablish the engaged position between gears 126 and 128 as shown in FIG. 2, and spring 102 urges element 106 against the upper surface of cam plate 114.

As described above, plunger 24 is depressed to initiate the flow of pressurized air to operate air motor 20, thus resulting in movement of segment gear 84 in proportion to the output torque of the wrench. Movement of segment gear 84 causes rotation of pinion 86 and shaft 88, whereby gear 128 on shaft 88 is rotated and drives gear 126. Movement of gear 126 causes rotation of shaft 118 and cam plate 114 until such time as cam plate 114 rotates to the position where notch 116 is aligned with cam element 106. When the alignment occurs between notch 116 and cam element 106, the cam element, which had been spring loaded against the upper face of cam plate 114 by spring 102, drops through notch 116 and spool valve 28 moves downward to a position whereby bulbous upper end blocks the flow of air through supply orifice 26. This termination of the air flow through supply orifice 26 shuts off air motor 20. In other words, the delivery of motive fluid is terminated, and hence torquing operation of the wrench is terminated when the desired preselected level of torque has been reached.

When the operator has finished tightening the element to be torqued, and it is desired to remove the wrench, the operator must operate the air motor in the reverse direction to unload the wrench. This is accomplished by rotating switch 21 to the opposite position, pulling upward on rod 132, and depressing plunger 24. If there has been any back drive at all through the system, cam element 106 will be under the lower surface of cam 114 and out of alignment with slot 116. The upward motion of rod 132 and spool valve 28 to reestablish the open position of the spool valve will bring pivotable end plate 108 into contact with the lower surface of cam 114 and will cause end plate 108 to pivot clockwise against spring 112 so that the cam element 106 can pass by cam plate 114. Spring 112 then pivots end plate 108 clockwise back to its normal position so that the cam element again rests on top of cam plate 114 and spool valve 28 is retained in the open position. Operation of the air motor in reverse direction then removes the load between end coupling 58 and the element which was torqued, and the wrench can be removed from the element when the load is reduced to at or near zero. It should be noted that this backing off of the load does not result in a loosening of the previously torqued element, but rather only removes the load which exists between the end coupling and the element. The wrench is then in a state ready for another cycle of operation, which will be either at the previously selected torque level if the setting of selector handle 122 is not changed, or at whatever new setting may be established for selector handle 122. It can thus be seen that the present invention results in a smoothly operating continuous torque device in which the output torque can be preselected and directly and accurately read out on the device.

While the wrench has been described as air powered, it can be powered by other sources, such as, for example, an electric motor or a hand operated crank. Any such alternative power source would simply be connected to rotate sun gear 44. The readout system could remain the same, but the preset system would have to be equivalently modified to suit the power source, e.g., to operate an electrical switch in the case of an electric motor, or omitted if the wrench is solely manually operated.

While a preferred embodiment has been shown and described, it will be understood that varius modifications may be made thereto without departing from the spirit and scope of the invention. Accordingly, the present invention has been described by way of illustration and not limitation.

What is claimed is:

1. A torque wrench including:

a casing;

input drive means in said casing receiving an operating input;

first planetary gear means in said casing drivingly connected to said input drive means;

rotatable output means connected to and driven by said first planetary gear means, said output means being adapted to engage an element to be torqued;

second planetary gear means in said casing drivingly connected to said input drive means;

said first and second planetary gear means having different gear ratios and common sun gear means;

reaction means coupled to said second planetary gear means;

load resisting means in said casing coooperating with said reaction means, said reaction means being movable within a limited range of movement against said load resisting means; and indicating means operatively connected to said reaction means to indicate the torque output of the wrench as a function of the movement of said reaction means.

2. A torque wrench as in claim 1 wherein:

corresponding planet gears of each planetary gear means are on a common shaft and are rotatably mounted in a movable race.

3. A torque wrench as in claim 2 wherein:

each of said planetary gear means includes a ring gear, said output means being integral with the ring gear of said first planetary gear means, and said reaction means being integral with the ring gear of said second planetary gear means.

4. A torque wrench as in claim 3 wherein:

the difference in gear ratio between said first and second planetary gear means is obtained by having an equal number of teeth on the ring gears of each planetary gear means and different numbers of teeth on the planetary gears of each gear means.

5. A torque wrench as in claim 3 wherein:

the difference in gear ratio between said first and second planetary gear means is obtained by having an equal number of teeth on the planetary gears of each planetary gear means and different numbers of teeth on the ring gears of each gear means.

6. A torque wrench as in claim 1 wherein:

said second planetary gear means includes a first ring gear; and said reaction means is integral with said first ring gear.

7. A torque wrench as in claim 6 wherein:

said reaction means is a reaction arm having an opening therein; and said load resisting means includes spring means positioned in said reaction arm opening, said reaction arm compressing said spring means between said casing and the reaction arm in response to torque imposed by the wrench on an element being torqued.

8. A torque wrench as in claim 7 wherein:

said reaction arm is movable in opposite directions depending on the direction of rotation of said output means.

9. A torque wrench as in claim 7 wherein said indicating means includes:

segment gear means on said reaction arm; and an indicating pointer operatively connected to said segment gear means.

10. A torque wrench as in claim 1 including:

power means for driving said input drive means.

11. A torque wrench as in claim 10 including:

shutoff means for terminating the operation of the torque wrench when a predetermined torque level has been reached.

12. A torque wrench as in claim 11 wherein said shutoff means includes:

switching means operably connected to said reaction means.

13. A torque wrench as in claim 12 wherein:

said power means is pneumatic fluid operated; and said switching means includes valve means to block the flow of fluid to said power means.

14. A torque wrench as in claim 13 wherein said shutoff means includes:

cam means operably connected to said reaction means, said cam means cooperating with said valve means to operate said valve means.

15. A torque wrench as in claim 11 including:

means for selecting the torque level at which said shutoff means operates.

16. A torque wrench as in claim 1 including:

means to prevent drive back through the wrench from said output means to said input drive means.

17. A torque wrench including:

a casing;

input drive means in said casing receiving an operating input;

first planetary gear means in said casing drivingly connected to said input drive means;

rotatable output means connected to and driven by said first planetary gear means, said output means being adapted to engage an element to be torqued;

second planetary gear means in said casing drivingly connected to said input drive means, said second planetary gear means including a ring gear;

reaction arm means integral with said ring gear of said second planetary gear means, said reaction arm means having an opening therein, and said reaction arm means being movable in opposite directions depending on the direction of rotation of said output means;

spring means in said casing positioned in said reaction arm means opening, said reaction arm means being movable within a limited range of movement against said spring means and compressing said spring means between said casing and said reaction arm means in response to torque imposed by the wrench on an element being torqued; and indicating means operatively connected to said reaction arm means to indicate the torque output of the wrench as a function of the movement of said reaction arm means.

18. A torque wrench as in claim 17 wherein:

corresponding planet gears of each planetary gear means are on a common shaft and are rotatably mounted in a movable race.

19. A torque wrench as in claim 17 wherein said indicating means includes:

segment gear means on said reaction arm; and an indicating pointer operatively connected to said segment gear means.

20. A torque wrench as in claim 17 including:

power means for driving said input drive means.

21. A torque wrench as in claim 17 including:

shutoff means for terminating the operation of the torque wrench when a predetermined torque level has been reached.

22. A torque wrench as in claim 21 wherein said shutoff means includes:

switching means operably connected to said reaction means.

23. A torque wrench as in claim 22 wherein:

said power means is pneumatic fluid operated; and said switching means includes valve means to block the flow of fluid to said power means.

24. A torque wrench as in claim 23 wherein said shutoff means includes:

cam means operably connected to said reaction means, said cam means cooperating with said valve means to operate said valve means.

25. A torque wrench as in claim 21 including:

means for selecting the torque level at which said shutoff means operates.

26. A torque wrench as in claim 17 including:

means to prevent drive back through the wrench from said output means to said input drive means.

27. A torque wrench as in claim 17 wherein:

each of said planetary gear means includes a ring gear, said output means being integral with the ring gear of said first planetary gear means, and said reaction means being integral with the ring gear of said second planetary gear means;

the gear ratio of said first planetary gear means being different from the gear ratio of said second planetary gear means.

28. A torque wrench as in claim 27 wherein:

the difference in gear ratio between said first and second planetary gear means is obtained by having an equal number of teeth on the ring gears of each planetary gear means and different numbers of teeth on the planetary gears of each gear means.

29. A torque wrench as in claim 27 wherein:

the difference in gear ratio between said first and second planetary gear means is obtained by having an equal number of teeth on the planetary gears of each planetary gear means and different numbers of teeth on the ring gears of each gear means.

* * * * *